US008869908B2

(12) United States Patent
Zhu et al.

(10) Patent No.: US 8,869,908 B2
(45) Date of Patent: Oct. 28, 2014

(54) ANTI-BOUNCE CONTROL SYSTEM FOR A MACHINE

(75) Inventors: Yongliang Zhu, Dunlap, IL (US); Phillip Newberry, Taylorville, IL (US); Owen Kolstad, Peoria, IL (US); Michael Subrt, Chillicothe, IL (US); Sam M. Kherat, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 29 days.

(21) Appl. No.: 13/465,875

(22) Filed: May 7, 2012

(65) Prior Publication Data

US 2013/0292144 A1 Nov. 7, 2013

(51) Int. Cl.
*E02F 3/76* (2006.01)

(52) U.S. Cl.
USPC ..... 172/4.5; 172/781

(58) Field of Classification Search
CPC ..... A01B 67/00; E02F 3/7663–3/7686; G05D 19/00–19/02
USPC ..... 172/2, 4.5, 780–799; 701/82, 90
See application file for complete search history.

(56) References Cited

U.S. PATENT DOCUMENTS

| | | | | |
|---|---|---|---|---|
| 3,058,310 | A | 10/1962 | Panissidi | |
| 4,468,050 | A | 8/1984 | Woods et al. | |
| 5,147,010 | A * | 9/1992 | Olson et al. | 180/197 |
| 5,147,172 | A | 9/1992 | Hosseini | |
| 5,474,147 | A * | 12/1995 | Yesel et al. | 180/197 |
| 5,622,226 | A | 4/1997 | Hausman et al. | |
| 5,884,204 | A * | 3/1999 | Orbach et al. | 701/50 |
| 5,890,870 | A | 4/1999 | Berger et al. | |
| 6,249,992 | B1 | 6/2001 | Irving et al. | |
| 6,644,429 | B2 * | 11/2003 | Evans et al. | 180/307 |
| 6,666,125 | B2 | 12/2003 | Gunzenhauser | |
| 6,705,079 | B1 | 3/2004 | Tabor et al. | |
| 6,749,035 | B2 | 6/2004 | Bundy | |
| 6,854,269 | B2 | 2/2005 | Hale | |
| 7,059,126 | B2 | 6/2006 | Ma | |
| 7,269,947 | B2 | 9/2007 | Yoshino | |
| 7,278,262 | B2 | 10/2007 | Moon | |
| 7,308,789 | B2 | 12/2007 | Lee | |
| 7,513,521 | B2 | 4/2009 | Posselius et al. | |
| 7,756,622 | B2 | 7/2010 | Gianoglio et al. | |
| 2003/0085042 | A1 | 5/2003 | Rogala | |
| 2004/0055455 | A1 | 3/2004 | Tabor et al. | |
| 2006/0070757 | A1 | 4/2006 | Posselius et al. | |
| 2006/0191692 | A1 * | 8/2006 | Holt et al. | 172/2 |
| 2008/0183356 | A1 | 7/2008 | Kale et al. | |
| 2008/0257569 | A1 | 10/2008 | Foster et al. | |
| 2010/0018726 | A1 | 1/2010 | Chiocco | |
| 2010/0051298 | A1 | 3/2010 | Smith et al. | |
| 2010/0108336 | A1 * | 5/2010 | Thomson et al. | 172/795 |
| 2011/0108294 | A1 * | 5/2011 | Thomson et al. | 172/1 |

FOREIGN PATENT DOCUMENTS

| | | | |
|---|---|---|---|
| EP | 0934448 | B1 | 3/2002 |
| JP | 07-286312 | A | 10/1995 |
| KR | 10-2007-0019830 | Y | 2/2007 |

* cited by examiner

*Primary Examiner* — Matthew D Troutman
(74) *Attorney, Agent, or Firm* — Leydig, Voit & Mayer, Ltd.

(57) ABSTRACT

A system for automated control of a motor grader includes a first sensor to indicate bounce of the motor grader and a speed sensor to indicate the ground speed. A controller determines a maximum amplitude of the bounce of the motor grader and controls the ground speed of the motor grader at least in part based upon the maximum amplitude of the bounce. A method is also provided.

19 Claims, 5 Drawing Sheets

ANTI-BOUNCE CONTROL SYSTEM FOR A MACHINE

TECHNICAL FIELD

This disclosure relates generally to controlling a machine and, more particularly, to a control system for reducing harmonic vibrations of the machine.

BACKGROUND

Certain machines such as motor graders have a natural frequency that may negatively affect their operation due to resonance at such natural frequency. The natural frequency of a motor grader is a function of numerous physical characteristics of the machine such as its weight distribution, the distance between the rear wheels and the moldboard, and the tire characteristics. In addition, the operating conditions encountered by the motor grader may also affect the natural frequency. Excitation at the natural frequency may result in harmonic vibrations within the motor grader commonly referred to as "bounce."

Harmonic vibrations or bounce typically occur when the motor grader is operated within a particular range of speeds and with a light load on the blade or moldboard. The movement caused by the bouncing condition may interrupt the contact between a work surface and the moldboard which may result in an uneven finish or scallop on the work surface. Such an uneven finish may require reworking of the work surface or the application of additional material for proper finishing.

Motor graders may experience three different types of harmonic vibrations or bounce: pitching, side-to-side or "duck-walk," and vertical vibrations or bounce. Each of these types of harmonic vibrations or bounce conditions may negatively impact a grading operation. Harmonic vertical movement or bounce generally occurs at a frequency between 1.5 and 3 Hz.

U.S. Patent Publication No. 2010/0051298 A1 discloses a system for detecting and dissipating hydraulic spikes in pressure caused when implements of a machine bounce. The pressure spikes are dissipated by generating random or canceling pulses within the hydraulic system.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

The disclosure describes, in one aspect, a system for automated control of movement of a motor grader having a prime mover and a ground engaging blade. A first sensor is disposed on the motor grader and is configured to provide a bounce signal indicative of a measured bounce of the motor grader. A speed sensor is disposed on the motor grader and is configured to provide a speed signal indicative of a ground speed of the motor grader. A controller is configured to receive the bounce signal from the first sensor and determine a maximum amplitude of the measured bounce of the motor grader based upon the bounce signal. The controller is further configured to generate a command signal to control the ground speed of the motor grader at least in part based upon the maximum amplitude of the measured bounce and transmit the command signal to change the speed of the motor grader.

In another aspect, the disclosure describes a controller implemented method of adjusting movement of a motor grader having a prime mover, a ground engaging blade, a first sensor configured to provide a bounce signal indicative of a measured bounce of the motor grader, and a speed sensor disposed on the motor grader configured to provide a speed signal indicative of a ground speed of the motor grader. The method includes receiving the bounce signal from the first sensor and determining a maximum amplitude of the measured bounce of the motor grader based upon the bounce signal. The method further includes generating a command signal within the controller to control the ground speed of the motor grader at least in part based upon the maximum amplitude of the measured bounce and transmitting the command signal from the controller to change the speed of the motor grader.

In still another aspect, the disclosure describes a motor grader including a prime mover, a ground engaging blade, a first sensor is disposed on the motor grader and is configured to provide a bounce signal indicative of a measured bounce of the motor grader, and a speed sensor is disposed on the motor grader and is configured to provide a speed signal indicative of a ground speed of the motor grader. A controller is configured to receive the bounce signal from the first sensor and determine a maximum amplitude of the measured bounce of the motor grader based upon the bounce signal. The controller is further configured to generate a command signal to control the ground speed of the motor grader at least in part based upon the maximum amplitude of the measured bounce and to transmit the command signal to change the speed of the motor grader.

DETAILED DESCRIPTION

Figure 1:
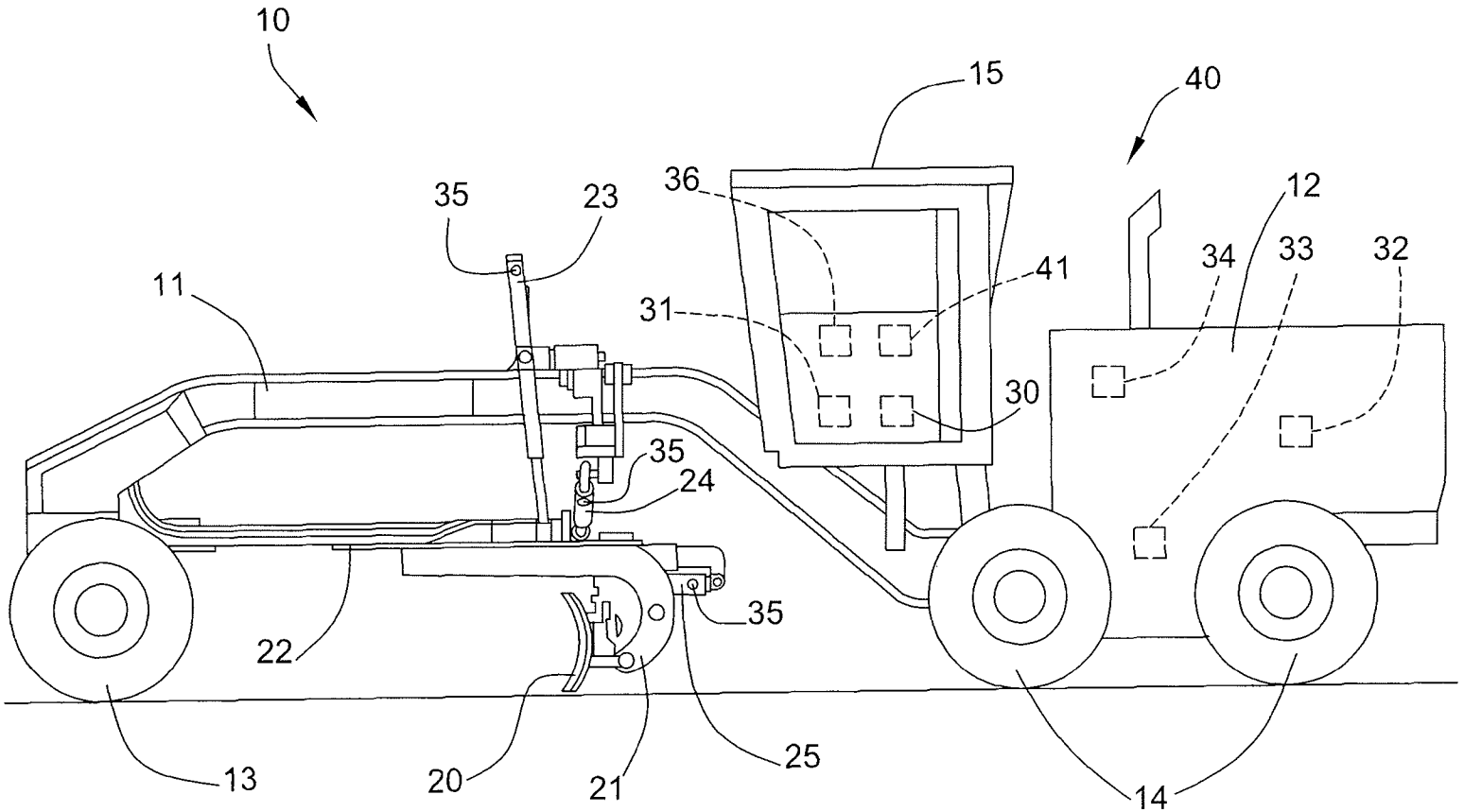
FIG. 1 is a side elevational view of a motor grader constructed in accordance with the disclosure.

FIG. 1 is a diagrammatic illustration of machine such as a motor grader 10 that may be used in accordance with an embodiment of the disclosure. The motor grader 10 includes a frame 11 and a prime mover such as an engine 12. A set of front wheels 13 may be operatively connected to the frame 11 generally adjacent a front end of the motor grader 10 and two sets of rear wheels 14 may be operatively connected to the frame 11 generally adjacent a rear end of the motor grader. In an alternate embodiment, only a single set of rear wheels 14 may be provided. One or both sets of rear wheels 14 may be powered by a power transfer mechanism (not shown) operatively connected to the engine 12. The power transfer mechanism may be any desired type of drive system including a hydrostatic propulsion system, an electric drive system or a mechanical drive system. An operator cab 15 may be mounted on the frame 11 and includes various controls, sensors and other mechanisms used by an operator.

A blade or moldboard 20 extends downward from the frame 11. The moldboard 20 may be mounted on a blade tilt adjustment mechanism 21 that is supported by a rotatable circle assembly 22 operatively connected to the blade tilt adjustment mechanism 21. A variety of hydraulic cylinders or other mechanisms may be provided for controlling the position of the moldboard 20. For example, circle assembly 22 may be supported by a pair of blade lift actuators 23 (with only one visible in FIG. 1). Adjustment of the blade lift actuators 23 allows the height of rotatable circle assembly 22, and hence the height of moldboard 20, to be adjusted. Blade lift actuators 23 may be moved independently or in combination with each other. A center shift cylinder 24 may be provided to shift the circle assembly 22 from side-to-side. A blade tip cylinder 25 may be provided to control the angle between an edge of the moldboard 20 and the ground. One or more side shift cylinders (not shown) may be provided to control lateral movement of the moldboard 20 relative to the circle assembly 22. The circle assembly 22 may include a mechanism such as gear teeth to allow rotation of the moldboard 20. Other manners of positioning and controlling the moldboard 20 may be utilized if desired.

Motor grader 10 may be equipped with a plurality of sensors that provide data indicative (directly or indirectly) of the performance or conditions of various aspects of the machine. An operator presence sensor 30 may be provided to sense whether an operator is seated within the operator cab 15. A parking brake sensor 31 may be provided to sense whether the parking brake is engaged. A transmission output speed sensor 32 may be provided for sensing the output speed from a transmission (not shown). A wheel speed sensor 33 may be provided for sensing the speed of the rear wheels 14 and thus indicate the ground speed of the motor grader 10.

One or more bounce sensors may be provided for sensing the bounce or movement of the motor grader 10. In one embodiment, a first sensor such as an accelerometer 34 may be provided on motor grader 10. The first sensor may be used to provide an acceleration signal indicative of measured acceleration of the motor grader 10 relative to a gravity reference. In one example, the first sensor may provide measurements in six degrees of freedom (i.e., fore-aft, lateral, and vertical directions as well as pitch, roll and yaw). In an alternate embodiment, the first sensor may be a three-axis accelerometer providing an acceleration signal indicative of measured acceleration of the motor grader along fore-aft, lateral and vertical directions. In another alternate embodiment, the first sensor may be a single-axis accelerometer providing the measurement of the mixed acceleration of the motor grader along fore-aft, lateral and vertical directions. By monitoring the acceleration at the first sensor, movements of the motor grader 10 may be detected that are indicative of motor grader bounce. In some circumstances, it may be desirable to place the first sensor generally adjacent the rear wheels 14. Still further, it may be desirable to position the first sensor generally adjacent operator cab 15 so that movement sensed by the first sensor somewhat matches movement sensed by the operator.

In another alternate configuration, the first sensor may include one or more hydraulic pressure sensors 35 associated with some or all of the hydraulic cylinders that are used to control the moldboard 20, the blade tilt adjustment mechanism 21 and the circle assembly 22. By monitoring the pressure and pressure changes in the cylinders, specific pressure characteristics may be monitored that are indicative of motor grader bounce. Other types of sensors are also contemplated.

A control system 40 may be provided to control the operation of the motor grader 10 including the anti-bounce control aspects or functionality of the machine. The control system 40, as shown generally by an arrow in FIG. 1 indicating association with the motor grader 10, may include an electronic control module such as controller 41. The controller 41 may receive operator input command signals and control the operation of the various systems of the motor grader 10. The controller 41 is shown in FIG. 1 residing in the operator cab 15 but may be mounted at any convenient location on motor grader 10. The control system 40 may include one or more input devices (not shown) to control the motor grader 10 and one or more sensors, including the operator presence sensor 30, the parking brake sensor 31, the transmission output speed sensor 32, the wheel speed sensor 33, and the first sensor, to provide data and other input signals representative of various operating parameters of the motor grader 10.

The controller 41 may be an electronic controller that operates in a logical fashion to perform operations, execute control algorithms, store and retrieve data and other desired operations. The controller 41 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller such as power supply circuitry, signal conditioning circuitry, driver circuitry, and other types of circuitry.

The controller 41 may be a single controller or may include more than one controller disposed to control various functions and/or features of the motor grader 10. The term "controller" is meant to be used in its broadest sense to include one or more controllers and/or microprocessors that may be associated with the motor grader 10 and that may cooperate in controlling various functions and operations of the machine. The functionality of the controller 41 may be implemented in hardware and/or software without regard to the functionality. The controller 41 may rely on one or more data maps relating to the operating conditions of the motor grader 10 that may be stored in the memory of controller. Each of these maps may include a collection of data in the form of tables, graphs, and/or equations. The controller 41 may use the data maps to maximize the efficiency of the motor grader 10.

The control system 40 may include an anti-bounce control system or functionality for assisting in controlling certain types of harmonic movement of the motor grader 10 known as bounce. In doing so, the controller 41 may be configured to receive as input values the amplitudes of movement of the motor grader 10 at certain frequencies at which bounce is likely to occur. Threshold values of the amplitude of the motor grader movement at each of specified or predetermined frequencies may be stored as a portion of the data maps to assist in determining the existence of a bounce condition. Maps of responses to motor grader bounce exceeding the threshold value may be established and stored within the controller 41. Such maps may utilize various factors including the speed of the motor grader 10, the extent to which the amplitude of the bounce exceeds the threshold value, and the frequency of the bounce condition. Other operating conditions and characteristics of the motor grader 10 may also be related in the data maps.

During the operation of the motor grader 10, as described in more detail below, the anti-bounce control functionality of control system 40 may modify the operating conditions of the motor grader to eliminate or reduce motor grader bounce. In one example, once the controller 41 determines that a bounce condition exists, it may override the gas pedal control command directed by the operator so as to reduce the engine speed and thus reduce the speed of the motor grader 10. Once the bounce condition has been sufficiently eliminated or reduced, the anti-bounce control functionality of the control system 40 is disengaged and no longer affects the operation of the engine 12 so that the engine speed is returned to that directed by the operator.

Figure 2:
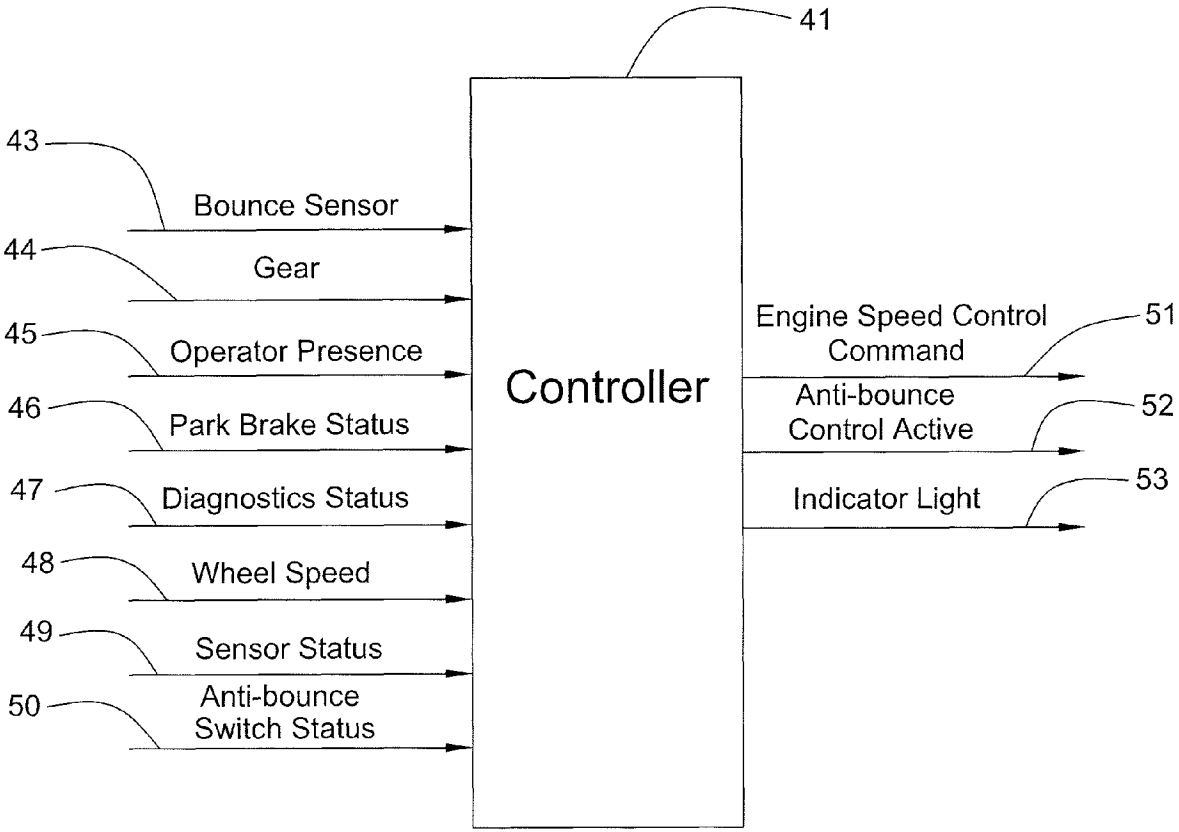
FIG. 2 is a block diagram of an anti-bounce control system in accordance with the disclosure.

As depicted in FIG. 2, the controller 41 receives information from various sensors and systems of the motor grader 10 and processes this information. Controller 41 may receive, at a node 43, a bounce signal or signals from a bounce sensor indicative of the bounce of the motor grader 10. The bounce sensor may be the first sensor such as an accelerometer 34 or hydraulic pressure sensors 35 on the hydraulic cylinders associated with the moldboard 20. At node 44, the controller 41 may receive a signal as to which gear has been selected by the operator for operating the motor grader 10. Such signal may be generated by another aspect of the control system that controls the operation of the transmission of the motor grader 10. At node 45, the controller 41 may receive a signal as to whether an operator is seated within the operator cab 15. The operator presence signal may be provided by operator presence sensor 30.

The controller 41 may receive a signal at node 46 as to whether the parking brake is engaged. The parking brake signal may be provided by a parking brake sensor 31. At node 47, the controller 41 may receive a signal as to the status of certain diagnostics of the anti-bounce control system. At node 48, the controller 41 may receive a signal indicative of the wheel speed of the front or rear wheels 14. The wheel speed signal may be provided by the wheel speed sensor 33. At node 49, the controller 41 may receive a signal as to the status of the various sensors that provide information to the anti-bounce control system. At node 50, the controller 41 may receive a signal from a user switch 36 as to whether the operator has engaged or disengaged the anti-bounce control system.

In one embodiment, the controller 41 may generate various output signals based upon the operation of the anti-bounce control system. At node 51, the controller 41 may provide a command signal such as an engine speed control command to control operation of the engine speed. The controller 41 made provide a signal at node 52 to communicate to other aspects of the control system 40 the status of the anti-bounce control system.

At node 53, the controller 41 may provide a signal to an indicator light (not shown) indicating whether the anti-bounce control functionality is in operation. For example, if the motor grader 10 is not in a bounce condition, the light may be off. If the motor grader 10 is experiencing bounce and the anti-bounce control functionality is operating, the light may be illuminated. If the motor grader 10 is in a bounce condition but the anti-bounce control functionality is not operating, the light may be flashing. Examples of when the motor grader 10 may be in a bounce condition but the anti-bounce control functionality is not operating include when the operator has turned off the anti-bounce control functionality or when other systems of the motor grader 10 that control the engine speed have a higher priority and take precedence over the anti-bounce control functionality.

Motor grader 10 may be equipped with a user interface 36 to activate and deactivate the anti-bounce control system of the control system 40. This user interface could be a switch or touch screen. If the user interface 36 is not activated, motor grader 10 will operate in accordance with the operator's commands regardless of the operating conditions encountered by the motor grader.

Figure 3:
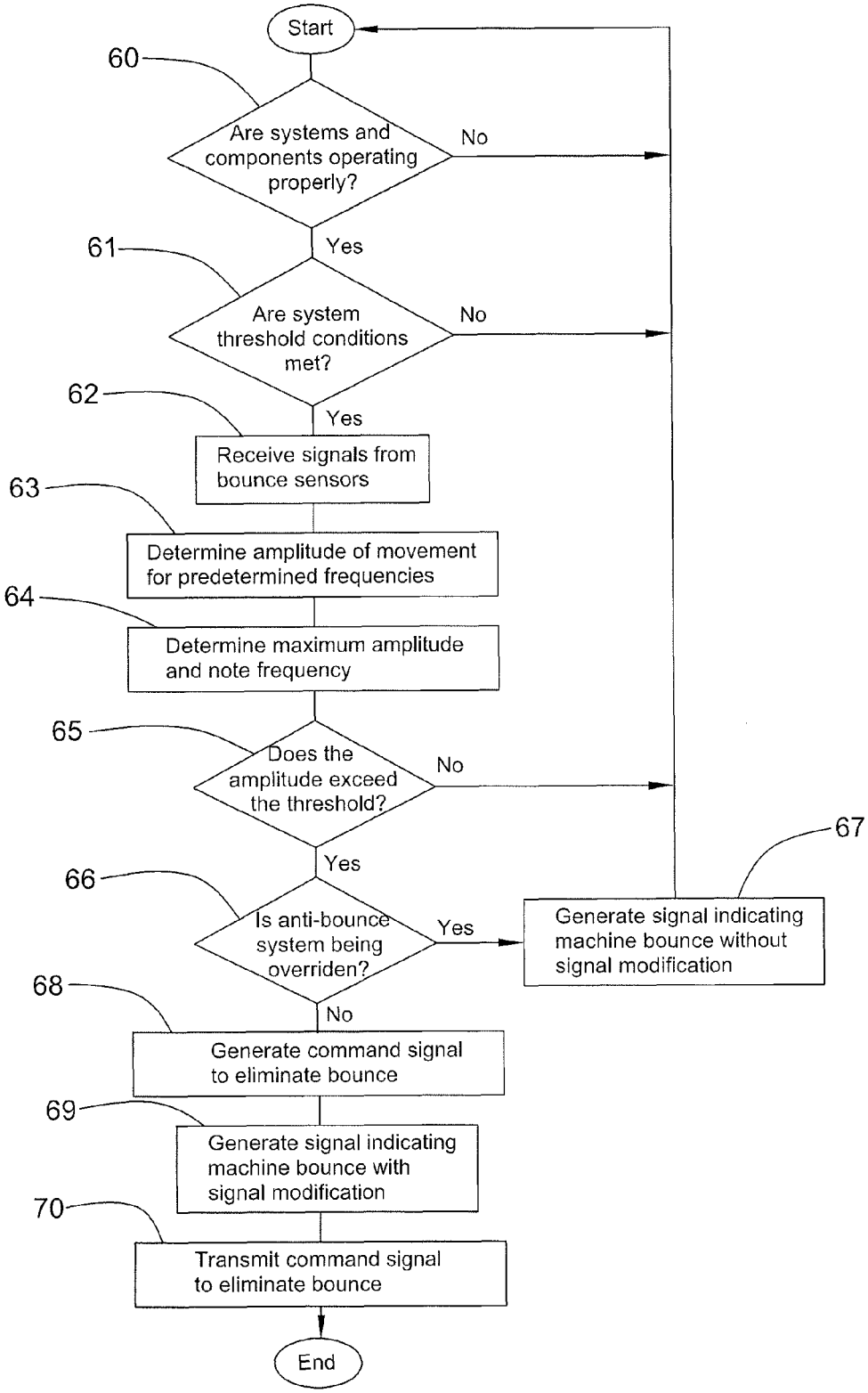
FIG. 3 is a flowchart illustrating an anti-bounce control process in accordance with the disclosure.

If the user interface 36 is activated, the control system 40 will operate in accordance with the flow chart of FIG. 3. The controller 41 may initially perform various diagnostic and system checks at stage 60 to determine that the anti-bounce control system and components of the motor grader 10 are operating properly. If any aspects of the system or components of motor grader 10 are not operating properly, controller will not activate the anti-bounce control functionality and the motor grader 10 will operate in accordance with the operator's commands even if bounce conditions are encountered.

At stage 61, the controller 41 determines whether certain threshold conditions of the anti-bounce control system have been met. For example, the anti-bounce control functionality may only be operative under certain operating conditions of the motor grader 10. One required operating condition may be that the transmission output speed must be within a predetermined range. An additional operating condition may be that the transmission is operating in certain predetermined gears. For example, bounce typically occurs and needs to be controlled to reduce the damage to the ground by the blade when the motor grader 10 is traveling between approximately 6-9 miles per hour. Accordingly, for a motor grader 10 having a transmission (not shown) with eight forward gears, the anti-bounce control functionality may only be operative when the transmission is in either the third or fourth gear. Operation in either the first or second gear may be too slow to create a bounce condition. Operation at the fifth gear and above may be too fast for the operator to conduct high quality grading work. As a result, it is unlikely that high quality grading work will be impacted if bounce conditions occur at such higher speed.

Additional required operating conditions may include the presence of an operator in the operator's seat and the disengagement of the parking brake. Still further, the wheel speed sensor 33 may provide a speed signal indicative of the ground speed of the motor grader 10. The speed signal may be monitored and the anti-bounce control system may function only if the wheel speed is below a predetermined threshold. For example, the controller 41 may be configured so that the anti-bounce control functionality is inoperative when the wheel speed is above approximately 10.5 miles per hour. At relatively high speeds (such as those above 10.5 miles per hour), the motor grader 10 is unlikely to be performing grading operations and is unlikely to encounter bounce conditions that negatively impact contact between the work surface and the moldboard 20.

The system may be configured so that the anti-bounce control functionality will be inoperative if any of the threshold conditions are not met. In other circumstances, the anti-bounce control functionality may be limited or otherwise adjusted depending on which threshold conditions have not been met.

If the system threshold conditions have been met at stage 61, the controller 41 receives at stage 62 bounce signals from the first or bounce sensors (such as an accelerometer 34 or hydraulic pressure sensors 35) that are indicative of movement of the motor grader 10. It should be noted that the natural frequency of each motor grader 10 is a function of numerous characteristics including weight and weight distribution, machine dimensions, and the tire characteristics. This bounce at the natural frequency could be triggered by various operating conditions encountered by the motor grader 10 (such as soil conditions and profile, blade movement, and gear and speed changes). Accordingly, when analyzing movement of the motor grader 10 for bounce, the controller 41 analyzes, at stage 63, the amplitude of movement of the motor grader 10 within certain frequency ranges.

In an example of vertical bounce of a motor grader 10, the controller 41 may analyze vertical movement of the motor grader 10 within a frequency range of between approximately 1.5 and 3 Hz. When performing such analysis, the controller 41 may analyze at stage 64 the amplitude of vertical movement at each frequency within the range and determine the maximum amplitude of movement as well as the frequency of such maximum movement.

In examples of both pitch and side-to-side bounce, the frequency range analyzed by the controller 41 may overlap with or be different from the frequency range of the vertical bounce. For each type of movement, the controller 41 may analyze at stage 64 the amplitude of the particular movement at each frequency within the range and determine the maximum amplitude of the movement as well as the frequency of such maximum movement.

At stage 65, the controller determines whether the maximum amplitude of movement exceeds a predetermined threshold. In one example, this may be carried out by comparing the maximum amplitude to data maps within the controller 41 corresponding to the specific frequency. If the maximum amplitude does not exceed the predetermined threshold, the anti-bounce control functionality is not activated and the motor grader 10 will operate in accordance with the operator's commands as any bounce conditions encountered are insufficient to warrant the anti-bounce control system overriding the operator commands.

If the maximum amplitude does exceed the predetermined threshold, the controller 41 may determine at stage 66 whether any other subsystems within control system 40 have priority over the anti-bounce control functionality. If the anti-bounce control functionality is being overriden, the motor grader 10 will operate without the anti-bounce control functionality. The controller may, at stage 67, generate a signal indicating that the motor grader 10 is operating in a bounce condition but the anti-bounce control functionality has been overriden. This may be indicated by a flashing indicator light within the operator cab 15.

If the anti-bounce control functionality is not being overriden at stage 66, the controller may, at stage 68, determine the appropriate action to eliminate the bounce condition and generate an appropriate command signal. In one example, the controller 41 may generate a command signal to reduce the speed of the engine 12 to slow down the motor grader 10. In another example, the command signal from the controller 41 may apply the service brakes of the motor grader 10. Other manners of reducing the speed of the motor grader 10 may be used. In some circumstances, it may be possible to terminate the bounce condition by increasing the speed of the motor grader 10. In such an example, the command signal from the controller 41 may increase the speed of the engine 12. The command signal generated by the controller may be based upon the operating conditions of the motor grader 10 as well as the amplitude and frequency of the bounce. For example, the controller 41 may reduce the engine speed substantially more quickly for a bounce condition that is substantially greater than the threshold condition as compared to a bounce condition that slightly exceeds the threshold condition.

The controller may, at stage 69, generate a signal indicating that the motor grader 10 is operating in a bounce condition and that the anti-bounce control functionality is operating. This may be indicated by energizing an indicator light within the operator cab 15. After generating the command signal, the command signal may be transmitted to the appropriate system at stage 70 to reduce or eliminate the bounce condition.

It should be noted that, as described above, motor grader 10 may experience three different types of bounce conditions (i.e., vertical, pitch and side-to-side) and at three frequencies. In other words, vertical bounce occurs in a first direction and at a first frequency, bounce in a pitch direction occurs in a second direction and at a second frequency, and side-to-side bounce occurs in a third direction and at a third frequency. They may not occur at identical frequencies. The data maps of controller 41 may contain data for each type of bounce and the process set forth in FIG. 3 repeated (simultaneously or sequentially) for each type of bounce. In doing so, controller 41 may determine a command signal to reduce or eliminate each type of bounce but only transmit the command signal to reduce the largest bounce.

In an alternate configuration, the controller 41 may determine, based upon the operating conditions and input from the three types of bounce, that an alternate or blended solution may be desirable to reduce or eliminate the bounce. In another alternate configuration, the controller 41 may generate a command signal that reduces each type of bounce without immediately eliminating any type of bounce. In still another alternate configuration, one type of bounce may be deemed more detrimental than another so that the controller prioritizes the generation of command signals to reduce or eliminate a particular type of bounce first. Such prioritization may also be dependent upon the relative amplitudes or the degree to which each type of bounce exceeds its respective threshold.

Figure 4:
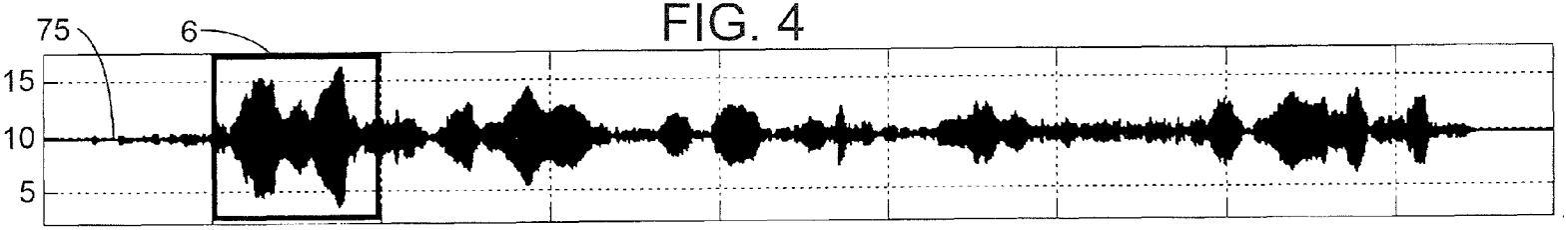
FIG. 4 is an exemplary graph of a simulation of vertical bounce of a motor grader.
Figure 5:
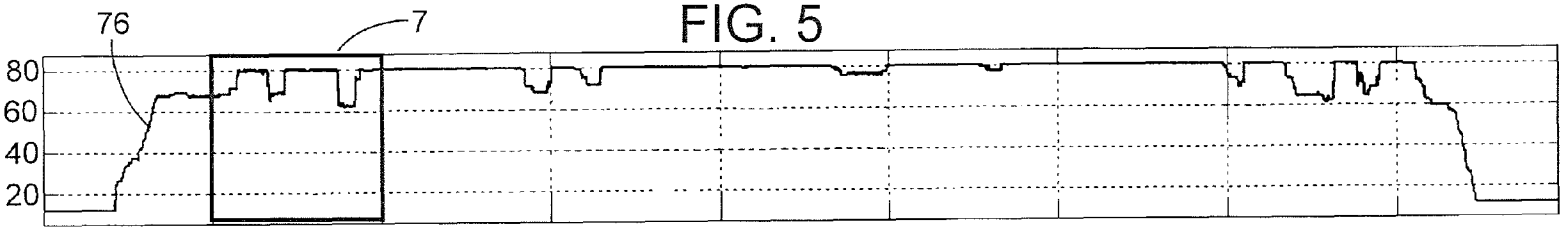
FIG. 5 is an exemplary graph depicting a simulation of gas pedal displacement corresponding to the vertical bounce depicted in FIG. 5.
Figure 6:
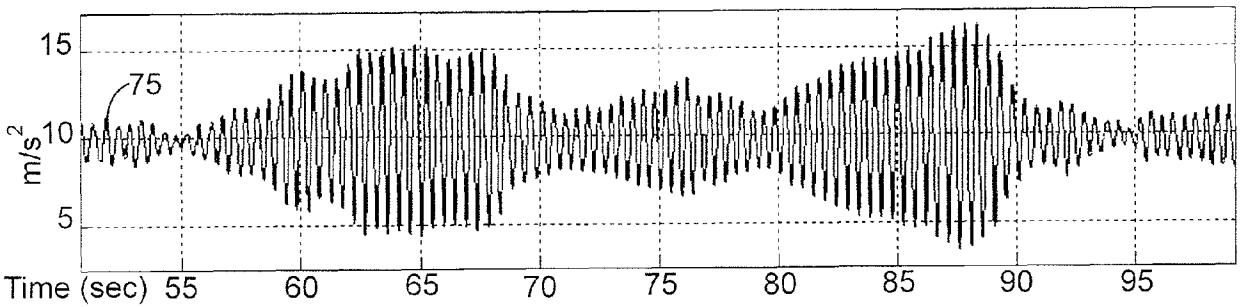
FIG. 6 is an enlarged view of the portion identified at 6 in FIG. 4.

Referring to FIG. 4, a graph of simulated vertical machine acceleration or bounce 75 of a motor grader 10 is depicted as a function of time. FIG. 5 depicts a simulated gas pedal displacement command 76 from an operator corresponding to the graph of FIG. 4 depicted as a percentage of possible gas pedal movement as a function of time and without the anti-bounce control functionality of control system 40. FIG. 6 is an enlarged view of the section of the graph of FIG. 4 within the box labeled 6, and FIG. 7 is an enlarged view of the section of the graph of FIG. 5 within the box labeled 7.

Figure 7:
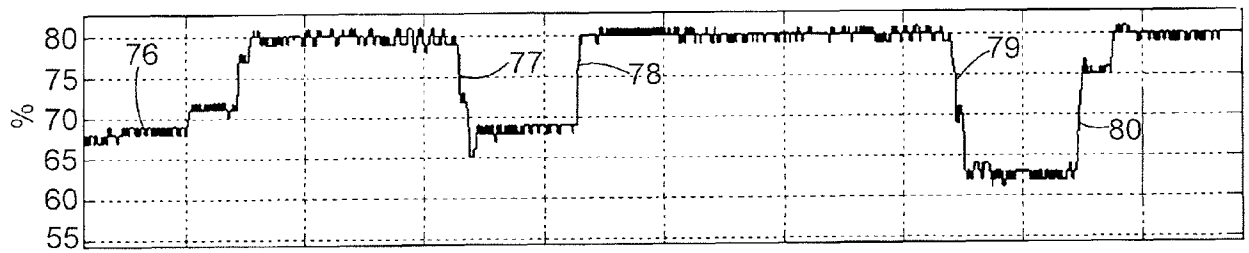
FIG. 7 is an enlarged view of the portion identified at 7 in FIG. 5.

In FIGS. 5 and 7, it may be seen that as the motor grader begins to vertically bounce, the operator may attempt to reduce the bounce by manually reducing the displacement of the gas pedal. However, referring to FIGS. 6-7, it may be seen that the vertical bounce begins to take effect slightly prior to approximately 60 seconds along the graph and the operator does not act to reduce the gas pedal displacement at 77 until approximately 67 seconds along the graph. The vertical bounce begins to decrease and the operator increases the gas pedal displacement at 78 corresponding to approximately 72 seconds along the graph. However, the vertical bounce may not have been sufficiently reduced and/or the increase in engine speed causes the motor grader 10 to begin to bounce again at approximately 80 seconds along the graph. The operator then reduces the gas pedal displacement at 79 corresponding to approximately 87 seconds along the graph to reduce the vertical bounce. At approximately 92 seconds along the graph, the bounce is reduced and the operator increases the gas pedal displacement at 80. In the simulation depicted in FIG. 7, the motor grader 10 experienced vertical bounce for approximately 30 seconds as the operator made repeated attempts to reduce the bounce.

Figure 8:
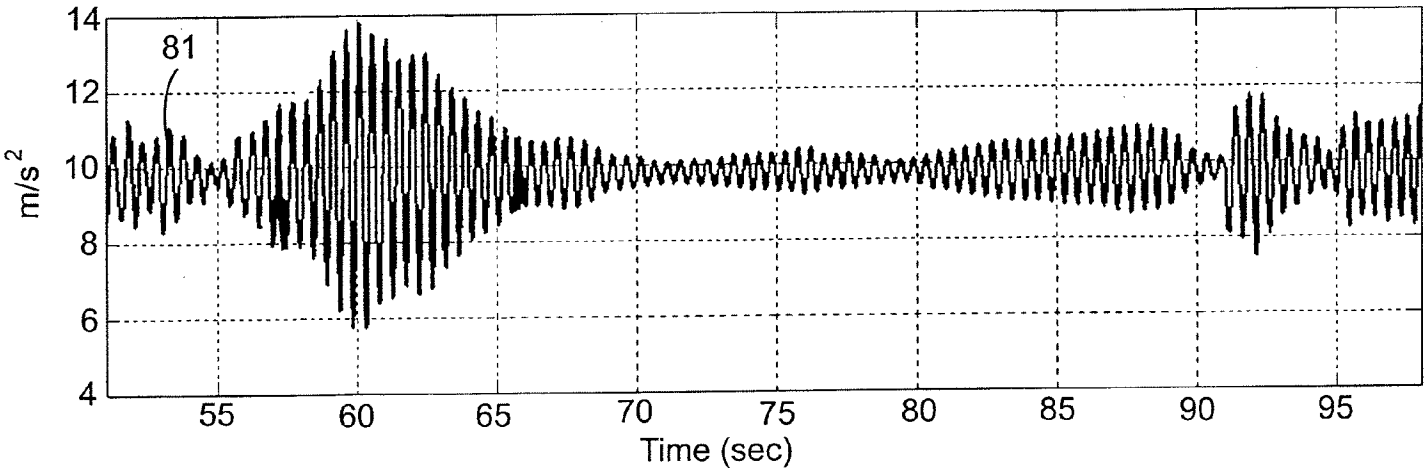
FIG. 8 is an exemplary graph, similar to FIG. 6, depicting simulated vertical bounce of a motor grader incorporating the anti-bounce control system in accordance with the disclosure.
Figure 9:
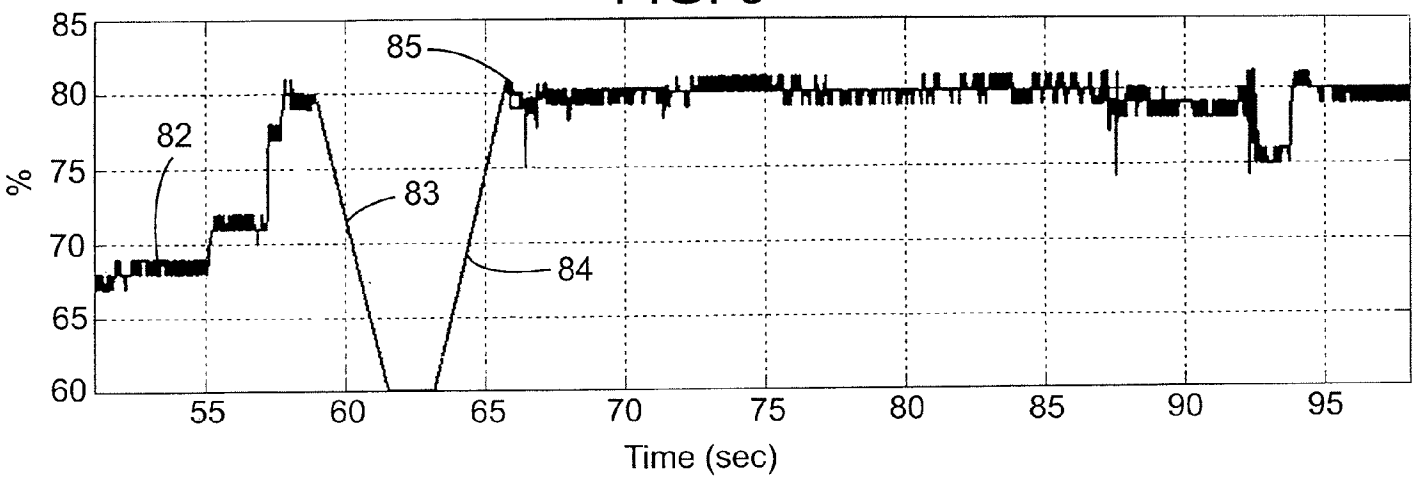
FIG. 9 is an exemplary graph, similar to FIG. 7, depicting a simulation of a gas pedal displacement command from an operator as well as a command generated by the anti-bounce control system when overriding the operator command.

FIGS. 8-9 depict a simulation of vertical bounce 81 of motor grader 10 and gas pedal displacement 82, respectively, with the anti-bounce control functionality of control system 40 operational. As the vertical bounce begins to take effect slightly prior to approximately 60 seconds along the graph, the anti-bounce control functionality of control system 40 overrides the gas pedal command from the operator and automatically reduces the gas pedal displacement at 83.

The anti-bounce control system then maintains the reduced gas pedal command and subsequently increases the command at 84 corresponding to approximately 63 second on the graph until the gas pedal command returns to the operator gas pedal command at 85 corresponding to approximately 66 seconds on the graph. It may be seen by comparing FIGS. 7 and 9 that the automated control provided by the control system 40 reduces the gas pedal displacement earlier than the operator and reduces the gas pedal command less abruptly, but also reduces the gas pedal command by a greater amount. As depicted in FIG. 8, the motor grader 10 experiences vertical bounce for a significantly shorter time period with the anti-bounce control system engaged. It should be noted that although the gas pedal displacement is greater in the example depicted in FIG. 9 as compared to FIG. 7, the rate of the reduction is less in FIG. 9 so that the operator may perceive a smaller decrease in engine and motor grader speed.

Although the anti-bounce control system is described above relative to controlling bounce conditions to minimize damage to a ground surface, in some situations, it may be desirable to utilize the system when the moldboard 20 is not engaging the ground. For example, a bounce condition may occur when the motor grader 10 is traveling at relatively high speeds and the moldboard is above the ground surface. In such case, the anti-bounce control system may be used to reduce the bounce condition and thus increase the comfort of the operator without affecting the ground surface.

Industrial Applicability

The industrial applicability of the system described herein will be readily appreciated from the foregoing discussion. The foregoing discussion is applicable to machines such as motor graders 10 for which harmonic vibrations or bounce may affect their operation. Individual characteristics of the machine as well as the operating conditions and environment affect the natural frequency of each machine. The anti-bounce control system disclosed herein determines the natural frequency of the motor grader 10 by analyzing movement of the motor grader, determining the maximum amplitude of movement and the frequency at which such movement occurs. The controller 41 may then reduce or eliminate the bounce by changing the speed of the motor grader 10 based upon various factors such as the amplitude of the bounce and the natural frequency of the motor grader as well as the operating conditions and other factors, if desired.

In one aspect, a system is described for automated control of movement of a motor grader 10 having a prime mover and a ground engaging blade. A first sensor is disposed on the motor grader 10 and is configured to provide a bounce signal indicative of a measured bounce of the motor grader. A speed sensor is disposed on the motor grader 10 and is configured to provide a speed signal indicative of a ground speed of the motor grader. A controller 41 is configured to receive the bounce signal from the first sensor and determine a maximum amplitude of the measured bounce of the motor grader 10 based upon the bounce signal. The controller 41 is further configured to generate a command signal to control the ground speed of the motor grader 10 at least in part based upon the maximum amplitude of the measured bounce and to transmit the command signal to change the speed of the motor grader.

In another aspect, the disclosure describes a controller implemented method of adjusting movement of a motor grader 10 having a prime mover, a ground engaging blade, a first sensor configured to provide a bounce signal indicative of a measured bounce of the motor grader, and a speed sensor disposed on the motor grader configured to provide a speed signal indicative of a ground speed of the motor grader. The method includes receiving the bounce signal from the first sensor and determining a maximum amplitude of the measured bounce of the motor grader 10 based upon the bounce signal. The method further includes generating a command signal within the controller 41 to control the ground speed of the motor grader 10 at least in part based upon the maximum amplitude of the measured bounce and transmitting the command signal from the controller 41 to change the speed of the motor grader.

In still another aspect, the disclosure describes a motor grader 10 including a prime mover, a ground engaging blade, a first sensor is disposed on the motor grader and is configured to provide a bounce signal indicative of a measured bounce of the motor grader, and a speed sensor is disposed on the motor grader and is configured to provide a speed signal indicative of a ground speed of the motor grader. A controller 41 is configured to receive the bounce signal from the first sensor and determine a maximum amplitude of the measured bounce of the motor grader 10 based upon the bounce signal. The controller is further configured to generate a command signal to control the ground speed of the motor grader at least in part based upon the maximum amplitude of the measured bounce and to transmit the command signal to change the speed of the motor grader.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for automated control of movement of a motor grader, the motor grader including a prime mover and a ground engaging blade, comprising:

a first sensor disposed on the motor grader configured to provide a bounce signal indicative of a measured bounce of the motor grader;

a speed sensor disposed on the motor grader configured to provide a speed signal indicative of a ground speed of the motor grader; and a controller configured to:

receive the bounce signal from the first sensor;

determine a maximum amplitude of the measured bounce of the motor grader based upon the bounce signal;

generate a command signal to change a speed of the prime mover at least in part based upon the maximum amplitude of the measured bounce, the speed of the prime mover controlling the ground speed of the motor grader; and transmit the command signal to change the ground speed of the motor grader.

2. The system of claim 1, wherein the controller is further configured to determine the maximum amplitude of the measured bounce in a first direction and within a first frequency range.

3. The system of claim 2, wherein the controller is further configured to determine the maximum amplitude of the measured bounce in a second direction and within a second frequency range.

4. The system of claim 3, wherein the first frequency range is different from the second frequency range.

5. The system of claim 3, wherein the controller is further configured to determined the maximum amplitude of the measured bounce in a third direction and within a third frequency range.

6. The system of claim 1, wherein the command signal reduces the speed of the prime mover.

7. The system of claim 1, wherein the controller is further configured to receive an operator-generated prime mover command signal from an operator and the command signal generated by the controller temporarily overrides the operator-generated prime mover command signal.

8. The system of claim 7, wherein the controller temporarily overrides the operator-generated prime mover command signal while the measured bounce exceeds a predetermined value.

9. A controller implemented method of adjusting movement of a motor grader, the motor grader having a prime mover, a ground engaging blade, a first sensor configured to provide a bounce signal indicative of a measured bounce of the motor grader, and a speed sensor disposed on the motor grader configured to provide a speed signal indicative of a ground speed of the motor grader, comprising:

receiving the bounce signal from the first sensor;

determining a maximum amplitude of the measured bounce of the motor grader based upon the bounce signal;

generating a command signal within the controller to change a speed of the prime mover at least in part based upon the maximum amplitude of the measured bounce, the speed of the prime mover controlling the ground speed of the motor grader; and transmitting the command signal from the controller to change the ground speed of the motor grader.

10. The controller implemented method of claim 9, further including determining the maximum amplitude of the measured bounce in a first direction and within a first frequency range.

11. The controller implemented method of claim 10, further including determining the maximum amplitude of the measured bounce in a second direction and within a second frequency range.

12. The controller implemented method of claim 9, further including reducing the speed of the prime mover.

13. The controller implemented method of claim 9, further including receiving an operator-generated prime mover command signal from an operator and temporarily overriding the operator-generated prime mover command signal with the command signal generated by the controller.

14. The controller implemented method of claim 13, wherein the operator-generated prime mover command signal is temporarily overridden while the measured bounce exceeds a predetermined value.

15. A motor grader comprising:

a prime mover;

a ground engaging blade;

a first sensor disposed on the motor grader configured to provide a bounce signal indicative of a measured bounce of the motor grader;

a speed sensor disposed on the motor grader configured to provide a speed signal indicative of a ground speed of the motor grader; and a controller configured to:

receive the bounce signal from the first sensor;

determine a maximum amplitude of the measured bounce of the motor grader based upon the bounce signal;

generate a command signal to change a speed of the prime mover at least in part based upon the maximum amplitude of the measured bounce, the speed of the prime mover controlling the ground speed of the motor grader; and transmit the command signal to change the ground speed of the motor grader.

16. The motor grader of claim 15, wherein the controller is further configured to determine the maximum amplitude of the measured bounce in a first direction and within a first frequency range.

17. The motor grader of claim 16, wherein the controller is further configured to determined the maximum amplitude of the measured bounce in a second direction and within a second frequency range.

18. The motor grader of claim 15, wherein the controller is further configured to receive an operator-generated prime mover command signal from an operator and the command signal generated by the controller temporarily overrides the operator-generated prime mover command signal.

19. The motor grader of claim 18, wherein the controller temporarily overrides the operator-generated prime mover command signal while the measured bounce exceeds a predetermined value.

* * * * *

UNITED STATES PATENT AND TRADEMARK OFFICE

CERTIFICATE OF CORRECTION

PATENT NO. : 8,869,908 B2
APPLICATION NO. : 13/465875
DATED : October 28, 2014
INVENTOR(S) : Zhu et al.

It is certified that error appears in the above-identified patent and that said Letters Patent is hereby corrected as shown below:

In the Specification

Column 9, line 38, delete "Industrial Applicability" and insert -- INDUSTRIAL APPLICABILITY --.

In the Claims

Column 11, line 31, in Claim 5, delete "determined" and insert -- determine --.

Column 12, line 47, in Claim 17, delete "determined" and insert -- determine --.

Signed and Sealed this
Seventeenth Day of November, 2015

Michelle K. Lee

Michelle K. Lee
*Director of the United States Patent and Trademark Office*